United States Patent [19]

Rokop et al.

[11] 4,286,649

[45] Sep. 1, 1981

[54] APPARATUS FOR STORING A CONTINUOUS CASTING STARTING BAR IN ELEVATED POSITION

[75] Inventors: Joseph Rokop; Nikolaus Rokop, both of Pittsburgh, Pa.

[73] Assignee: Rokop Corporation, Pittsburgh, Pa.

[21] Appl. No.: 159,698

[22] Filed: Jun. 16, 1980

[51] Int. Cl.[3] ..... B22D 11/08

[52] U.S. Cl. ..... 164/446; 164/426; 254/97

[58] Field of Search ..... 164/446, 426; 254/97

[56] References Cited

U.S. PATENT DOCUMENTS

| | | | |
|---|---|---|---|
| 3,374,828 | 3/1968 | Menu | 164/445 |
| 3,628,595 | 12/1971 | Mitchell | 164/426 X |
| 3,823,763 | 7/1974 | Hofmann et al. | 164/426 |
| 3,930,533 | 1/1976 | Rokop et al. | 164/426 |
| 4,108,237 | 8/1978 | Brovman et al. | 164/425 |

*Primary Examiner*—Robert D. Baldwin
*Assistant Examiner*—J. Reed Batten, Jr.
*Attorney, Agent, or Firm*—Brown, Flick & Peckham

[57] ABSTRACT

A starting bar for a flow-through continuous casting mold is curved lengthwise in a vertical plane and has a trailing end for joining to a metal strand issuing from the mold, and a leading end portion provided with a row of rack teeth extending along the bar. A storage housing spaced laterally from the mold has a vertical passage through it for receiving the leading end portion of the bar when the bar is moved lengthwise from a strand-receiving position to the storage housing and up into its passage where a vertical gear will be engaged by the rack teeth. An overrunning clutch operatively connected with the gear permits it to free wheel as the rack teeth move upwardly across the gear, but rotation of the clutch in the opposite direction when the bar, freed from a strand, is moving downwardly through the passage and turning the gear is controlled by driving means that include means for preventing rotation of the clutch in that direction by the gear while the driving means is idle, whereby the starting bar can be supported from the housing by means of the gear. A latch tooth for meshing with the gear to hold it stationary when the downwardly moving uppermost rack tooth leaves the gear is supported by means engageable by the leading end of the rising starting bar for disengaging the latch tooth from the gear just before the uppermost rack tooth rising in the housing passage reaches the gear, whereby the uppermost rack tooth will mesh with the gear and start turning it.

5 Claims, 4 Drawing Figures

APPARATUS FOR STORING A CONTINUOUS CASTING STARTING BAR IN ELEVATED POSITION

U.S. Pat. No. 3,930,533 shows continuous casting apparatus that includes a housing for supporting and storing a starting bar after a strand issuing from the bottom of a mold has been separated from the bar. FIG. 7 of the Patent shows a gear associated with the storage housing for engagement by a gear rack secured to the starting bar. When the starting bar is driven up through the housing the rack teeth mesh with the gear, which is free wheeling in a clockwise direction. The gear cannot turn in the opposite direction unless driven in that direction by a motor, so the gear will support the starting bar in the housing while the motor is not running. In order to make sure that the uppermost tooth on the rack will mesh with the gear as the bar is driven up in the storage housing by pinch rolls and the strand, the gear rack has a short pivoted section at its upper end so that if the uppermost tooth engages the outer end of a gear tooth the rack tooth will be swung back far enough to permit it to pass the gear tooth and then mesh with the gear. Although in general such an arrangement has been satisfactory, it has been found that the pivoted upper end of the rack bar is subject to wear and may need adjustment periodically. It also is subjected to harsh conditions of dirt, water and heat. Since it is very important that the rack always mesh with the gear as the starting bar moves up in the storage housing, it is an object of the present invention to improve upon the arrangement shown in the patent by eliminating its shortcomings.

The continuous casting apparatus improved by the present invention may have the same general appearance and construction as shown in FIG. 1 of the Patent, which is incorporated by reference herein, but since the present invention is in the means for supporting and storing the starting bar after it has been disconnected from a strand, only such means and the starting bar are illustrated herein.

The preferred embodiment of the invention is described in the accompanying drawings, in which FIG. 1 is a fragmentary side view of part of continuous casting apparatus showing a starting bar suspended from a storage housing;

Figure 4:
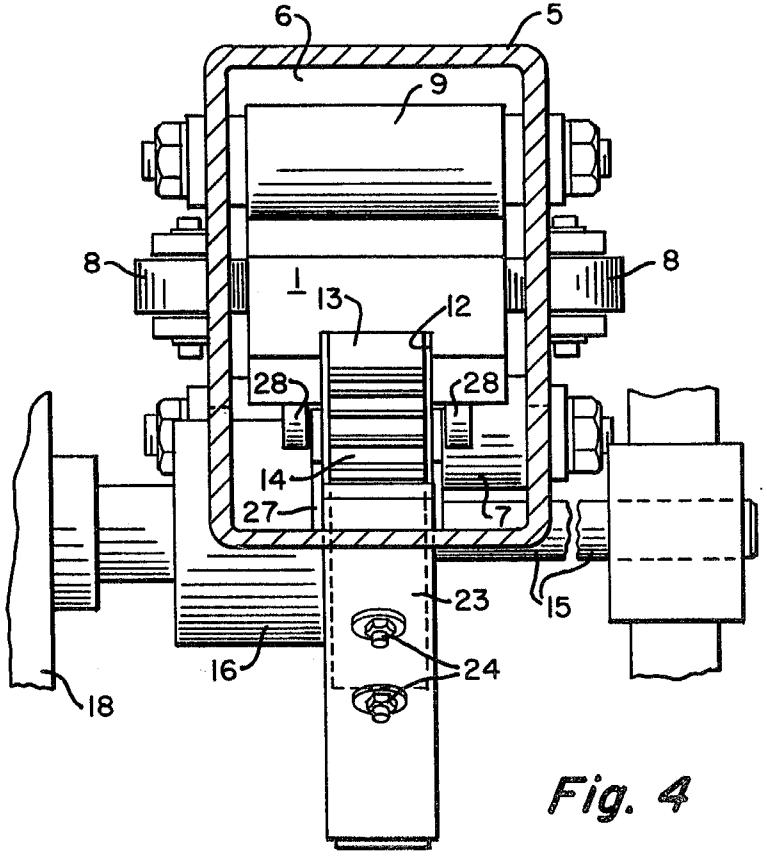
FIG. 4 is an enlarged vertical section taken on the line IV—IV of FIG. 2.
Figure 1:
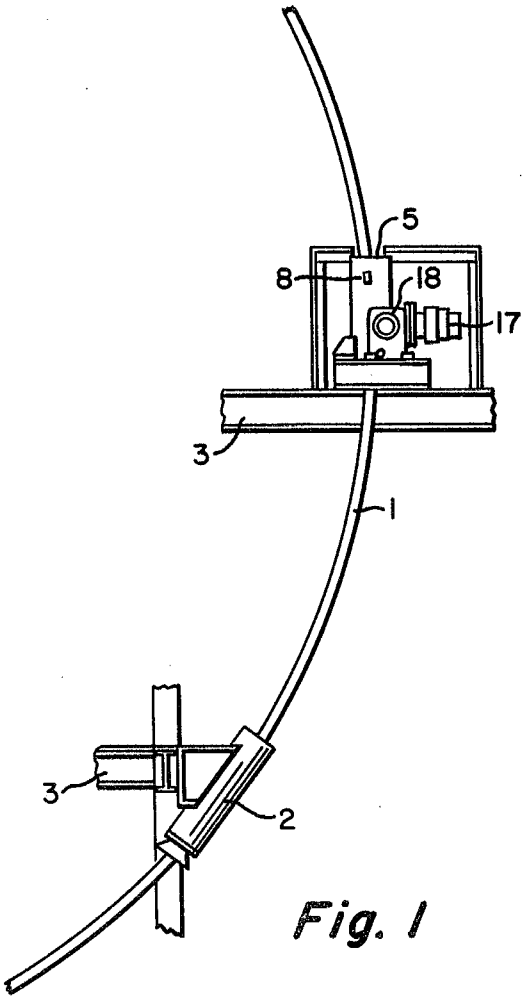
Figure 3:
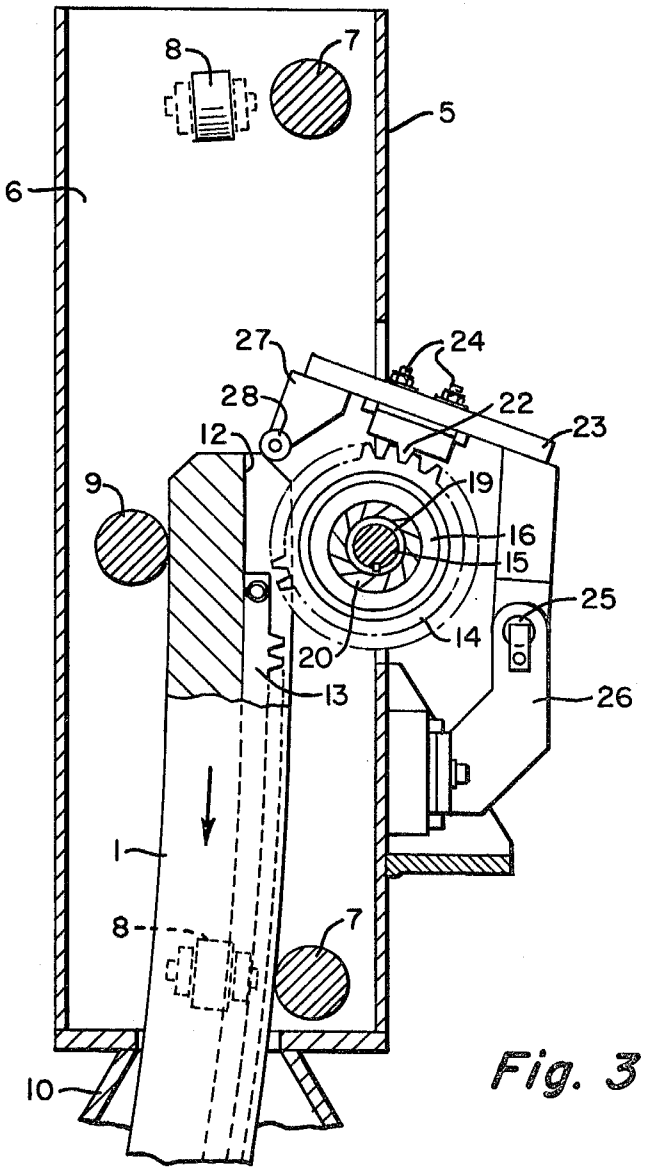
FIG. 3 is a similar view but showing the starting bar descending away from the gear.
Figure 2:
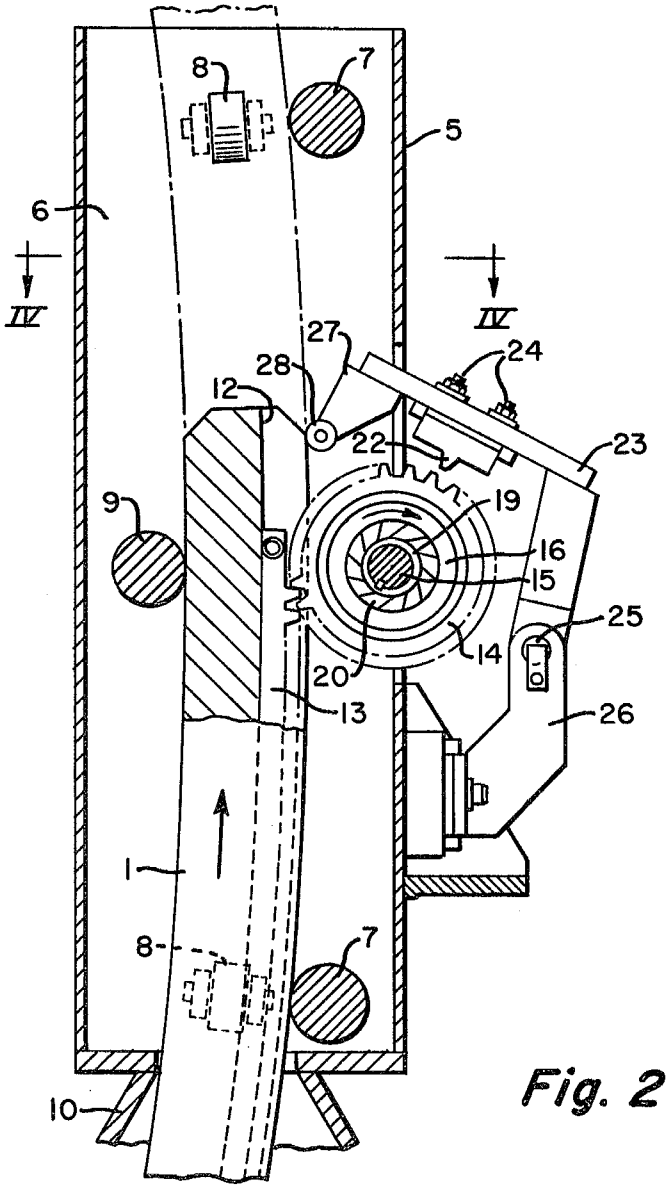
FIG. 2 is an enlarged fragmentary side view, partly in section, showing a starting bar rack rising into engagement with the supporting gear.

As shown in U.S. Pat. No. 3,930,533, the starting bar is curved in a vertical plane and has a trailing end for joining to a metal strand issuing from the bottom of a continuous casting mold as the starting bar is moved forward away from the mold by means of pinch rolls. As shown in FIG. 1 herein, the bar 1 eventually travels upwardly in an arcuate path, to which it is confined by suitable guides 2 mounted on the framework 3 that supports the continuous casting mold (not shown herein) and the storage apparatus about to be described. When the trailing end of the starting bar reaches a predetermined position at the bottom of the framework, the strand is separated from it and is led away over a conveyor in a well-known manner. Before this happens, the leading end of the starting bar is driven upwardly into apparatus for holding the bar while the strand is being disconnected from it and for storing the bar until it is needed again. This storing apparatus includes a vertical housing 5 provided with a vertical passage 6 through it for the bar as shown in FIGS. 2, 3 and 4. Inside the passage at top and bottom there are guide rollers 7 for engaging the convex side of the bar and other guide rollers 8 for engaging the other two sides of the bar. Another roller 9, about midway of the passage, is positioned for engaging the concave side of the bar. A tapered ring 10 guides the starting bar into the bottom of the housing.

The leading end portion of the starting bar is provided in its convex side with a slot 12 that extends lengthwise along it for a predetermined distance which may, for example, equal about one-third the length of the bar. Rigidly mounted in this slot is a long gear rack 13 secured in any suitable manner against the curved inner wall of the slot. The rack teeth are designed to mesh with a vertical gear 14 rotatable around a horizontal clutch shaft 15 that is rotatably mounted in such a position that the gear projects into the guide housing passage opposite the central guide roller 9. This gear is bolted to one side of the outer race 16 of an overrunning clutch mounted on shaft 15, which in turn is driven from an electric motor 17 (FIG. 1) through a worm gear in the housing 18 (FIG. 4) of a speed reducer. The inner race 19 of the clutch is keyed to the shaft. Between the two clutch races there are suitable conventional means 20, such as wedges, that permit the outer race of the clutch to turn the inner race only when the outer race is turned by the gear in a counterclockwise direction as viewed in FIGS. 2 and 3.

While the starting bar is being moved upwardly past the gear by means of pinch rolls previously mentioned, shaft 15 does not need to be driven because the outer race of the clutch will simply overrun the stationary inner race. Consequently, while the strand is being separated from the trailing or lower end of the starting bar and afterwards, the bar cannot move downwardly through the storage housing because the bar will be supported by the gear, which is stationary because the outer race of the clutch is unable to turn in the reverse or counterclockwise direction relative to the inner race that is held stationary by the worm gear. As a result of this construction, the motor does not have to be, and is not, operated while the starting bar is being pushed up through the storage housing at a speed determined by the pinch rolls. When the strand is disconnected from the starting bar, it will be suspended in its elevated position, as shown in FIG. 1, supported by gear 14 because the clutch shaft cannot turn until its driving motor is operated. To lower the bar, the clutch is driven by its motor in the direction (counterclockwise) that will allow the starting bar to descend by gravity at a controlled speed until its leading end has left the gear.

In order to make sure that each time the starting bar is driven up into the storage housing the uppermost rack tooth will mesh with the gear and not jam against a gear tooth, it is a feature of this invention that means are provided for locking the gear against any movement the moment the upper rack tooth leaves the gear when the starting bar is allowed to move down out of the storage housing. By stopping and locking the gear at this moment, one can be assured that when the starting bar is moved back up into the housing, the gear will be in the correct position for the upper tooth of the rack to mesh with the gear and start turning it, it being understood, as will be explained, that just as the rack starts to mesh with the gear the means that locked the gear is removed so that the gear can be turned by the rising bar.

Locking of gear 14 in fixed position as the gear rack leaves it is accomplished by a latch tooth 22 that is moved into and out of engagement with another part of the gear. This latch tooth, shown in FIGS. 2 and 3, is supported by a bracket 23 overlying the gear and also extending down beside the gear at the side opposite the starting bar. The latch tooth is fastened by bolts 24 to the central area of the bottom of the portion of the bracket that extends across the top of the gear. The lower end of the bracket is mounted on a horizontal pivot pin 25 mounted in the upper end of a support 26 attached to the storage housing. Secured to the opposite end of bracket 23 is a downwardly extending member 27 provided with a pair of laterally spaced rollers 28 that are located above the upper end of the starting bar and in its path of movement while latch tooth 22 engages the gear as shown in FIG. 3.

OPERATION

As the bar moves upwardly in the housing passage, its upper end engages the rollers and moves them upwardly a short distance, which causes the bracket to swing away from the gear and remove the latch tooth from the gear as shown in FIG. 2. This happens just as the upper rack tooth meshes with the gear. Thereafter, as the starting bar continues to move up through the housing passage the rollers 28 engage the side of the bar that faces the gear. When the starting bar is lowered in the storage housing the bracket rollers 28 will roll onto the upper end of the bar just as the upper rack tooth is leaving the gear. As the bar descends, the rollers descend with it and allow the upper end of the bracket 23 to swing down and insert the latch tooth between two of the gear teeth as shown in FIG. 3, whereby the gear is locked against rotation and in the correct position for receiving the gear rack the next time the starting bar moves up through the storage housing.

When this apparatus is first set up, the latch tooth 22 is adjusted on bracket 23 so that it will mesh with the gear at the same time as the starting bar rack leaves gear 14. Further adjustment can be made, if necessary, where bracket support 26 is attached to the storage housing. After these adjustments have been made, it is unnecessary to readjust later. The latch mechanism does not contain any elements that will wear during normal operation. The position of the latch tooth relative to the gear is such that the tooth can be forced out of mesh with the gear if the motor were accidentally, or during testing, driven in the direction (clockwise) to raise the starting bar. In this direction the outer race of the clutch is driven by the reversible motor, thereby driving the gear. Due to the position of the bracket pivot 25, damage to the latch or motor is avoided because the latch tooth will slip out of mesh with the gear. Since the latch tooth forms positive means for holding the gear in a fixed position relative to the starting bar rack teeth, there is no need for a movable gear rack section, such as shown in the above-mentioned patent, in the starting bar. Since the latching mechanism is external to the starting bar and gear it can be designed extremely strong to withstand abuse. Also, since the mechanism does not need to be adjusted, it can be completely enclosed by a cover to protect it from tampering and the harsh environment.

This invention is not only applicable to the continuous casting industry, but also wherever it is necessary to positively engage a moving rack with a gear.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Apparatus for use with a flow-through continuous casting mold, said apparatus comprising a starting bar curved lengthwise in a vertical plane and having a trailing end for joining to a metal strand issuing from the bottom of such a mold, the leading end portion of said bar being provided with a row of rack teeth extending along the bar for a predetermined distance, a storage housing adapted to be spaced laterally from the mold and having a substantially vertical passage therethrough for receiving said leading end portion of the bar, means for moving the starting bar lengthwise from a strand-receiving position to said storage housing and up into said housing passage, a vertical gear projecting into one side of said housing for engagement by said rack teeth when in said passage, an overrunning clutch operatively connected with said gear permitting the gear to free wheel as said rack teeth move upwardly across the gear a predetermined distance, driving means for controlling rotation of the clutch in the opposite direction when the bar freed from a strand is moving downwardly through said passage and turning said gear, the driving means including means for preventing rotation of the clutch in said opposite direction by said gear while the driving means is idle to thereby support the starting bar from said housing by means of the gear, a latch tooth for meshing with said gear to hold the gear stationary as the downwardly moving uppermost rack tooth leaves the gear, and means supporting said latch tooth and engageable by said leading end of the rising starting bar for disengaging said latch tooth from the gear just before said uppermost rack tooth rising in the housing passage reaches the gear, whereby said uppermost rack tooth will mesh with the gear and start turning it.

2. Apparatus according to claim 1, in which said clutch includes inner and outer races with clutching means between them, and means rigidly connecting the outer race to one side of said gear, said driving means including a shaft rigidly connected to said inner race, and a reversible motor for rotating the shaft in either direction.

3. Apparatus according to claim 1, in which said latch tooth supporting means includes a bracket overlying said gear, means securing the latch tooth to the bracket, one end of the bracket being located above the leading end of said bar while the latch tooth meshes with said gear, and means pivoting the opposite end of the bracket on a horizontal axis to permit the leading end of the bar to lift said one end of the bracket to thereby remove the latch tooth from the gear.

4. Apparatus according to claim 3, in which said bracket has a portion extending across the top of said gear, the latch tooth being secured to said bracket portion, and the bracket has another portion extending downwardly from said first-mentioned portion to said pivoting means at the side of the gear opposite said housing passage.

5. Apparatus according to claim 3, in which said one end of the bracket carries a roller engaged by the side of said bar as said leading end portion moves upwardly in said housing passage after lifting the bracket.

* * * * *